US005135097A

United States Patent [19]

Saito et al.

[11] Patent Number: 5,135,097

[45] Date of Patent: Aug. 4, 1992

[54] PEOPLE MOVER APPARATUS

[75] Inventors: Chuichi Saito, Katsuta; Yoshio Sakai, Naka; Hideaki Takahashi, Katsuta; Kazuhira Ojima, Kasama; Kazumi Kobune; Hisao Chiba, both of Katsuta, all of Japan

[73] Assignee: Hitachi, Ltd., Tokyo, Japan

[21] Appl. No.: 704,928

[22] Filed: May 23, 1991

[30] Foreign Application Priority Data

May 30, 1990 [JP] Japan ..... 2-138232

[51] Int. Cl.[5] ..... B66B 23/22

[52] U.S. Cl. ..... 198/330; 198/322

[58] Field of Search ..... 198/322, 323, 330

[56] References Cited

U.S. PATENT DOCUMENTS 4,499,986 2/1985 Tsuboi et al. ..... 198/323 X

FOREIGN PATENT DOCUMENTS 3416399 11/1984 Fed. Rep. of Germany ..... 198/330
3611597 10/1987 Fed. Rep. of Germany ..... 198/322
0039272 3/1977 Japan ..... 198/330
0269882 11/1987 Japan .
1-281287 11/1989 Japan ..... 198/322
2-33084 2/1990 Japan ..... 198/330

*Primary Examiner*—Robert P. Olszewski
*Assistant Examiner*—James R. Bidwell
*Attorney, Agent, or Firm*—Antonelli, Terry, Stout & Kraus

[57] ABSTRACT

An escalator comprises a plurality of treadboards, coupled with each other in the endless form, for conveying people thereon, a driving device for driving the treadboards, which has a driving mechanism, including an electric motor, for transmitting a driving force from the motor to the treadboards and a power converting unit for supplying electric power to the motor. Component devices of the driving device are categorized into two groups in consideration of heat generated in the respective component devices. Component devices, which are categorized into a group of heat generating devices, are installed in a machine room, and component devices, which are categorized into a group of heat sensitive devices, are installed in another machine room. The two machine rooms are arranged in different locations within an escalator frame, which are remote from each other in the direction of the length of the frame.

16 Claims, 4 Drawing Sheets

PEOPLE MOVER APPARATUS

BACKGROUND OF THE INVENTION

1. Field of the Invention

The present invention relates to a people mover apparatus, such as an escalator and a moving sidewalk, and particularly to the improvement of a people mover system with a power converting unit.

2. Description of the Related Art

Nowadays, there is known, for example, by the issued Japanese Patent Application JP-A-62-269882 (1987), a people mover apparatus of the type where an induction motor is provided for driving the apparatus by selectively providing to the apparatus by a power converting unit. The moving speed of the apparatus is adjusted in accordance with the necessity. However, the aforesaid prior art never gives any consideration to the constructional arrangement of various kinds of component devices of a driving and controlling system for a people mover apparatus, such as a driving motor, a power converting unit, a control device therefor and so on.

A people mover apparatus of this type has additional component devices, such as a power converting unit and devices related thereto, which a people mover apparatus of the conventional type never had. Without any special consideration of the constructional arrangement of component devices, therefore, the people mover apparatus becomes large in size as a whole, compared with a conventional people mover apparatus. This causes a problem with installation of the people mover apparatus in a building.

Further, a people mover apparatus of this type has more component devices, which generate heat, noise and/or vibration giving the undesirable influence to other component devices and the environment, compared with a conventional people mover apparatus. If all of the component devices are accommodated in a single machine room, like a conventional people mover apparatus, sources of heat, noise and vibration are concentrated, whereby other kinds of problems, such as the undesirable temperature rise, serious noise or vibration caused by a resonance phenomenon and the like, will be seriously caused.

SUMMARY OF THE INVENTION

An object of the present invention is to provide a people mover apparatus with a power converting unit, which is easy to install in a building without causing any other problems.

Most generally, a feature of the present invention is in that component devices included in a driving mechanism of a people mover apparatus are categorized into at least two groups and component devices of different groups are arranged in different locations of the people mover apparatus, which are remote from each other. Those locations are usually remote in the direction of the length of the people mover apparatus.

With the constructional arrangement of component devices as mentioned above, it becomes unnecessary to provide the large size of a machine room for accommodating the component devices, which has conventionally been provided on either end of a people mover apparatus. Instead, plural separate machine rooms of the smaller size are provided, most preferably on both ends of a people mover apparatus and, further, on an appropriate location of a middle portion of the people mover apparatus, if necessary. With this, the categorized component devices are accommodated in the respective machine rooms, whereby a people mover apparatus never causes the increase in size as a whole and, hence, can be easily installed in a building.

The component devices can be categorized from the point of view of a predetermined factor influencing the environment. By way of example, the component devices can be categorized in consideration of heat generated by the respective component devices in such a manner that heat generating devices are made to belong to a group and heat sensitive devices to another group. The component devices of the respective groups are accommodated in different machine rooms. With this, the temperature rise within a machine room for accommodating the heat sensitive devices, such as electronic equipment, for example, can be suppressed below an allowable temperature of the equipment.

Further, if the component devices are categorized in consideration of noise or vibration created by the respective devices, the noise or vibration locally created can be prevented from becoming seriously large.

DESCRIPTION OF THE PREFERRED EMBODIMENTS

In the following, the description will be given of embodiments of the present invention, in which the invention is applied to an escalator, with reference to the accompanying drawings.

Figure 1:
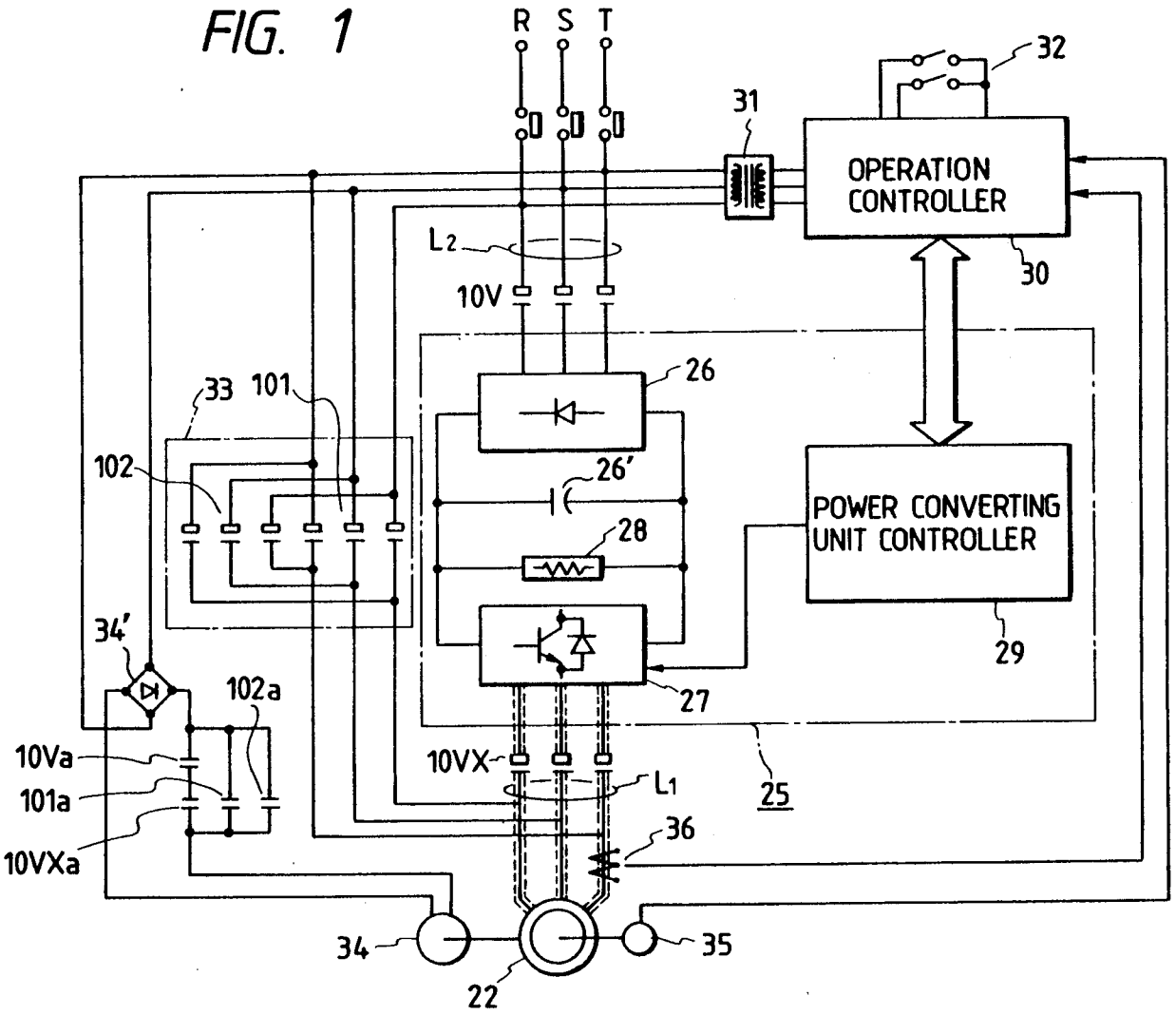
FIG. 1 shows an example of a driving and controlling system for an escalator with a power converting unit.

Referring at first to FIG. 1, the description will be given to the overall component arrangement of a driving and controlling system of an escalator of the type that a driving motor can be selectively fed directly by a three phase ac power source or through a power converting unit, in order to make it clear what component devices are included in the driving and controlling system for the escalator of this type. Since, however, the present invention does not have any particular close relationship to the component arrangement of this system itself, the following explanation will be made briefly.

An induction motor 22 is coupled to ac power source, R,S,T of the three phases through power converting unit 25 surrounded by a dotted chain line. As is well known, the unit 25 comprises converter 26, capacitor 26' and inverter 27, and if necessary, resistor 28 is further added across the dc side of the inverter 27. The converter 26 is coupled to the ac power source R,S,T by line $L_2$ through contacts 10V, and the inverter 27 is coupled to the converter 26 on its dc side and to the induction motor 22 on its ac side by line $L_1$ through contacts 10VX.

The power converting unit 25 further includes power converting unit controller 29, which will be referred to more in detail later. The contacts 10V and 10VX are contacts which are closed under the control of operation controller 30 as explained later, only when the motor 22 is to be fed by the power converting unit 25.

Further, as understood from the existence of capacitor 26' on the dc side of the converter 26, the power converting unit 25 shown is of the so called voltage source type. However, it should be noted that the present invention can also be realized by the use of the so called current source type power converting unit.

The resistor 28 consumes electric power regenerated by the motor 22 during the downward movement using the power converting unit 25, as heat. Therefore, the resistor 28 must be provided with a cooling fan (not shown). If the regenerated electric power is not consumed as heat, but returned to the ac power source R,S,T, the resistor 28 can be omitted. Further, the converter 26 and the inverter 27 generate some heat and are usually accommodated in a single container box. Therefore, they are also necessary to be cooled by a fan (not shown) provided in the box.

The ac power source R,S,T is also coupled to the motor 22 through electromagnetic contactor 33, which has two sets 101, 102 of three phase contacts. Either one of the two sets of the contactor 33 is closed, when the motor 22 is to be fed directly by the ac power source R,S,T. When the contacts 101 are closed, the motor 22 rotates in the rotational direction for the upward movement of the escalator, and when the contacts 102 are closed, the motor rotates in the rotational direction for the downward movement thereof.

Further, the ac power source R,S,T supplies the electric power to operation controller 30 through transformer 31. The controller 30, which includes a microcomputer, receives various instructions given by switches 32 as well as speed and load signals from detectors 35, 36 as described later, and executes the predetermined processing operation to produce signals to the power converting unit controller 29 and signals for selectively closing the contacts 101 or 102 or the contacts 10V and 10VX.

The ac power source R,S,T is also coupled to rectifier 34', the output of which excites electromagnetic brake 34 through contacts 101*a*, 102*a* or 10V*a* and 10VX*a*. The electromagnetic brake 34 is coupled to the axle of the motor 22 and gives the braking force to the motor 22, when it is deenergized. The contacts 10V*a*, 10VX*a*, 101*a* and 102*a*, which are of the normally open type, are auxiliary contacts of the corresponding contacts 10V, 10VX, 101 and 102.

Further, rotary encoder 35 is coupled to the axle of the motor 22 to detect the rotating speed thereof. An output signal of the rotary encoder 35 is given to the operation controller 30. If necessary, load detector 36 will be further provided. The detector 36 detects the current of the motor 22 and gives its output to the operation controller 30 as a load signal. With these signals, the fine control of the escalator operation can be realized and the abnormal operation of the escalator can be detected.

In the arrangement mentioned above, it is at first determined, by the user's or caretaker's manipulation of one of the switches 32, whether the motor 22 is to be fed by the power converting unit 25 or directly by the power source R,S,T. In the case where the power converting unit 25 is used, the operating speed of an escalator is also instructed by manipulating another of the switches 32.

If it is instructed that the power converting unit 25 is used to feed the motor 22, the operation controller 30 produces a signal for closing the contacts 10V and 10VX. If, otherwise, it is instructed that the motor 22 is to be fed directly by the power source R,S,T, the operation controller 30 produces a signal for closing either the contacts 101 or the contacts 102 in accordance with an instructed moving direction of the escalator.

When the operation controller 30 produces the aforesaid signal and accordingly either the contacts 101 or the contacts 102, or the contacts 10V and 10VX are closed, the corresponding auxiliary contacts 101*a*, 102*a*, or 10V*a* and 10VX*a* are closed simultaneously, whereby the electromagnetic brake 34 is excited to release the braking force and the motor 22 starts rotating at an instructed speed.

By way of example, the component devices as mentioned above will be categorized as follows, in consideration of heat generated by respective component devices. The moor 22, the converter 26, the inverter 27, the resistor 28, the transformer 31 and the electromagnetic brake 34 are categorized into the heat generating device, and on the other hand, the operation controller 30 which includes the microcomputer belongs to the heat sensitive device. From the point of view of noise or oscillation, a driving mechanism including the motor 22 and various moving parts will categorized into the noise or oscillation generating device.

By the way, a single machine room may be able to accommodate all of the component devices as mentioned above, if its capacity is made large. As described above, some of the component devices as mentioned above and fans for cooling them generate heat, oscillation and/or noise. If all of the component devices are accommodated in such a single machine room, sources of generating heat, oscillation and/or noise are concentrated.

As a result, there is a danger, for example, that the temperature within a machine room rises to exceed the allowable temperature, e.g., 50° C., of the microcomputer of the operation controller 30. Further, it is easily presumed that the concentration of the source of noise and vibration will cause many other problems.

Then, according to an embodiment of the present invention, all of the component devices as mentioned above are arranged in the people mover apparatus in such a manner as described hereinbelow, with reference to FIGS. 2 to 5.

Figure 2:
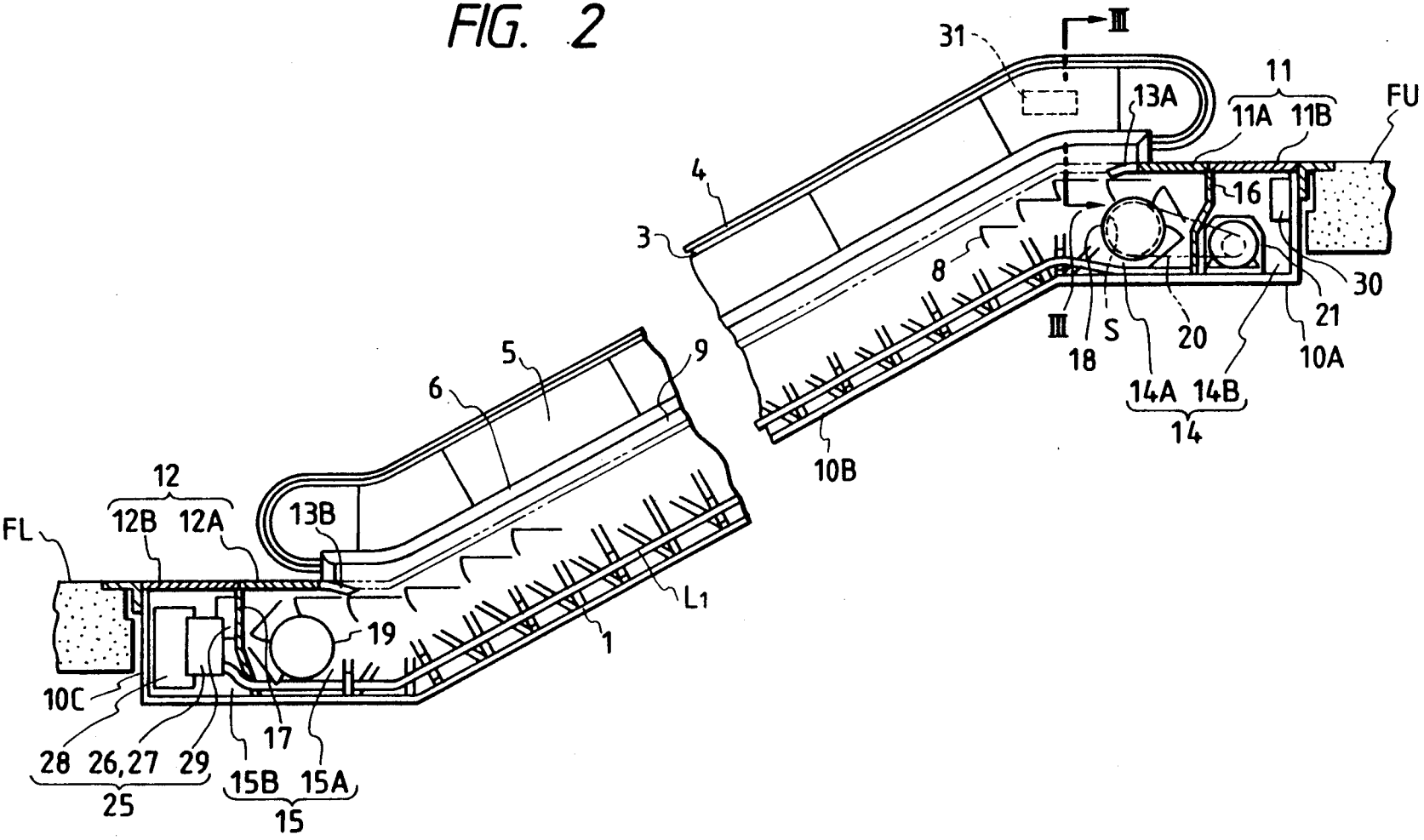
FIG. 2 schematically shows a partially sectioned view of an escalator as an example of a people mover apparatus according to an embodiment of the present invention.
Figure 3A:
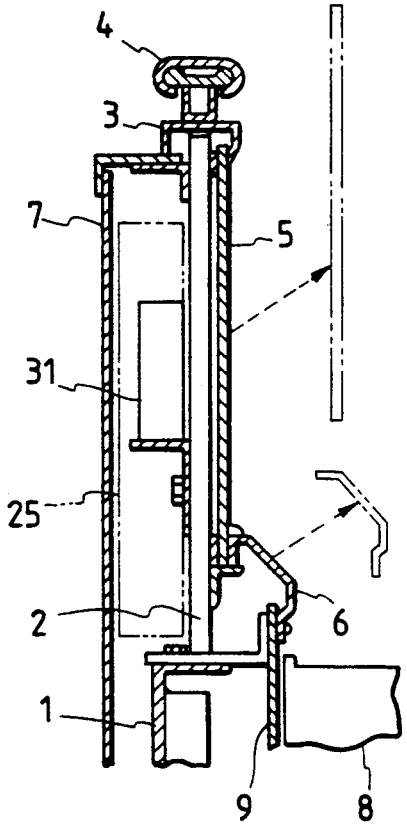
FIGS. 3*a* and 3*b* schematically show sectional views of two examples of a balustrade of the escalator, which is sectioned alone a chain line III —III in FIG. 2.

As shown in FIG. 2 and FIG. 3*a*, an escalator has escalator frame 1 installed between upper floor FU and lower one FL. On an upper chord of the frame 1, plural posts 2 for supporting a balustrade are provided at predetermined intervals in the direction of the length of the frame 1.

On the top of the plural posts 2, there is attached handrail frame 3 which extends in the direction of the length of the frame 1, and endless handrail 4 moves on the handrail frame 3, while guided thereby. The handrail 4, although not shown, returns under the posts 2.

There is provided, inside the escalator with respect to the posts 2, interior panel 5, the upper end of which is fixed to the handrail frame 3 and the lower end thereof to the neighbor of the lower ends of the posts 2. Interior ledge 6 is attached to the lower portion of the interior panel 5. Further, outside the escalator with respect to the posts 2, there is provided exterior panel 7, the upper end of which is fixed to the handrail frame 3 and the lower end thereof extends over the lower ends of the posts 2 so as to cover the frame 1.

The interior and exterior panels 5 and 7 are made of opaque material, such as an opaque acrylic resin plate, a stainless steel plate, a lithic plate or a wooden plate.

Inside the lower portion of the balustrade as constructed above, there are movably provided plural treadboards 8 linked in the endless form and attached to a step chain (not shown for simplicity of the drawing). Further, skirt guard 9 is positioned between the treadboards 8 and the interior ledge 6.

Figure 3B:
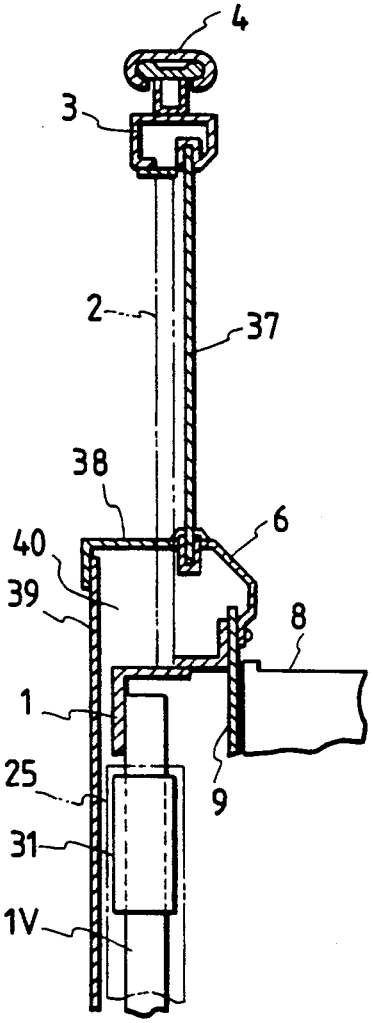

The balustrade as shown in FIG. 3*a* and mentioned above is opaque, but there is also a people mover apparatus having a transparent balustrade. FIG. 3*b* shows a sectional view of a typical example of such a balustrade. Identical reference numerals to those in the previous figures indicate identical parts.

In this type of the balustrade, there is provided reinforced glass panel 37, the bottom end of which is supported by an appropriate fixture (not shown) provided on the upper chord of the frame 1, and to the top end of which there is attached the handrail frame 3. The balustrade of this type is further divided into two types, one of which is not provided with the supporting posts 2. In this case, the handrail frame 3 is supported directly by the glass panel 37. Another type of the balustrade has posts 2 for supporting the handrail frame 3 in the same manner as shown in FIG. 3*a*.

Inside the lower portion of the glass panel 37, there are provided the interior ledge 6 and the skirt guard 9 attached thereto. Outside the lower portion of the glass panel 37, there are provided deck board 38 and panel 39 as an exterior covering.

Returning again to FIG. 2, the frame 1 can be considered as being formed by horizontal upper portion 10A, inclined middle portion 10B and horizontal lower portion 10C. In the upper and lower horizontal portions 10A and 10C, there are formed upper and lower machine rooms 14 and 15, respectively, which are further divided by partition plates 16 and 17 into two rooms, i.e., inner machine rooms 14A, 15A and outer machine rooms 14B, 15B.

The machine rooms 14A, 14B, 15A and 15B are covered by floor plates lIA, lIB, 12A and 12B, respectively, which are provided detachably from the frame 1 and function as a lid for the respective machine rooms. When the component devices accommodated therein are maintained or repaired, the floor plates 11A, 11B, 12A and 12B can be opened or removed. On the sides of the upper and lower floor plates lIA and 12A, which face the treadboards 8, combplate members 13A, 13B and fixed to the frame 1 with a small air gap against the treadboards 8.

In the upper and lower inner machine rooms 14A and 15A, driving sprocket 18 and driven sprocket 19 are rotatablely supported, respectively, and an endless step chain (not shown) is provided between the two sprockets 18, 19. The plural treadboards 8 are attached to the endless step chain. An axle of the driving sprocket 18 is provided with another sprocket S, which is driven, through driving chain 20, by driving device 21, which is, as described below, provided in the outer upper machine room 14B. Although not shown for simplicity of the drawing, the handrail 4 is also driven by a sprocket rotating synchronously with the sprocket 18.

Figure 4:
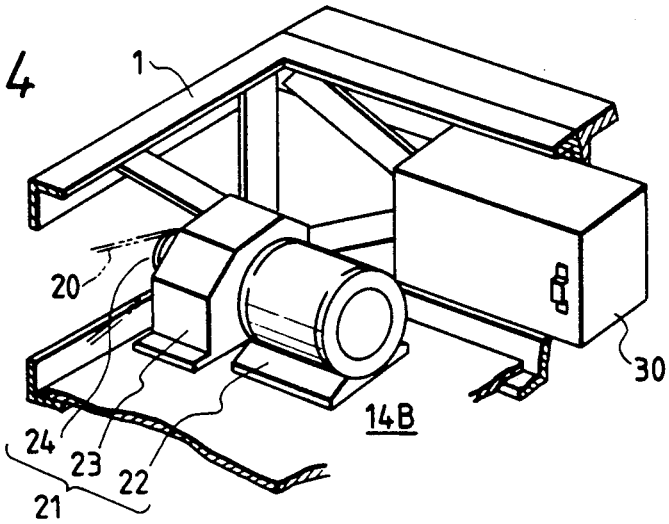
FIG. 4 shows an example of a part of an upper machine room of the escalator of FIG. 2.

The driving device 21 is provided in the outer upper machine room 14B, a partial view of which is shown in FIG. 4. As shown in the figure, the driving device 21 comprises the three phase induction motor 22 and reduction gear 23, an input axle of which is coupled to the motor 22 and an output axle thereof to sprocket 24 for driving the driving chain 20. The outer upper machine room 14B also accommodates the operation controller 30. It is to be noted here that an amount of heat generated by the motor 22 is usually smaller than that generated by the converter 26, the inverter 27, the resistor 28 and so on.

Figure 5:
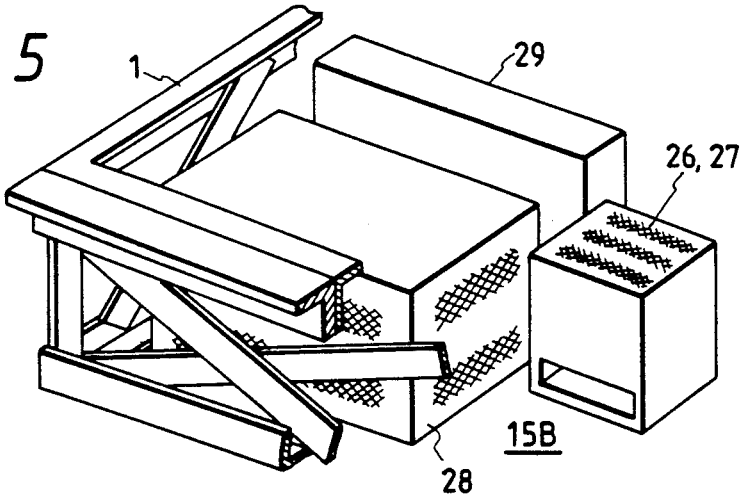
FIG. 5 shows an example of a part of a lower machine room of the escalator of FIG. 2.

In the outer lower machine room 15B, as shown in FIG. 5, there are provided a box accommodating both the converter 26 and the inverter 27, a box including the resistor 28 and a box for the power converting unit controller 29. Namely, devices, which have the comparatively large heat generation, are accommodated in the outer lower machine room 15B. Since the machine room 15B is remote from the machine room 14B and there are the partition plates 16 and 17 therebetween, the heat generated by the devices of the machine room 15B is scarcely transmitted to the machine room 14B, so that the microcomputer of the operation controller 30, which is accommodated in the machine room 14A, never receives any bad influence from the heat generated by those devices.

Further, in the case shown in FIG. 3*a*, an inner space is formed within the balustrade where some of the component devices can be accommodated. In FIG. 3*a*, there is shown the example that the transformer 31 or the power converting unit 25 is supported by the post 2 within the inner space of the balustrade. Since the interior plate 5 can be removed by detaching the lower ledge 6, as shown by broken arrow lines and dotted chain lines, the transformer 31 can easily be maintained or repaired. Also in the case of the transparent balustrade as shown in FIG. 3*b*, some of the component devices can be accommodated in an appropriate space within the frame 1 under the balustrade and supported by beam 1V of the frame 1.

Similarly, a location, in which some of the component devices are accommodated, can be formed even in the middle portion of the escalator in the direction of the length thereof.

Further, in the embodiment mentioned above, the motor 22 is arranged in the upper outer machine room 14B and the power converting unit 25 in the lower outer machine room 15B. Therefore, the motor 22 and the power converting unit 25 must be electrically coupled by the long power line $L_1$. The current flowing through the line $L_1$ includes various kinds of harmful harmonic components caused by the control of the inverter 27. Preferably, therefore, a shield cable is to be used for the power line $L_1$, whereby the bad influence on electronic equipment closely existing can be prevented.

The inventors measured the level of noise of an escalator, in which component devices are arranged in a manner as described above. The locations of measurement are points of 1 meter high over the upper floor plate 11 and the lower floor plate 12. The result of the measurement is as follows.

TABLE 1

| Measurement location | Level of noise |
|---|---|
| Upper floor plate | 63 dB |
| Lower floor plate | 61 dB |

There levels are almost the same as or somewhat lower than the level of noise in the conventional escalator. Further, when it is considered that the measurement took place in the inventors' factory for an escalator before the completion and therefore the escalator was not yet provided with the partition plates 16, 17 and the exterior plate 39, it is expected that the level of noise will be able to be further lowered in a completed escalator.

Also, the temperature rise within the upper machine room 14 and the lower machine room 15 was measured. The result thereof is as follows.

TABLE 2

| Location of measurement | Temperature rise |
|---|---|
| Upper machine room | 18° C. |
| Lower machine room | 26° C. |

The temperature rise 18° C. of the upper machine room 14 does not give any bad influence on the microcomputer of the operation controller 30, which is accommodated in the upper machine room 14.

Figure 6:
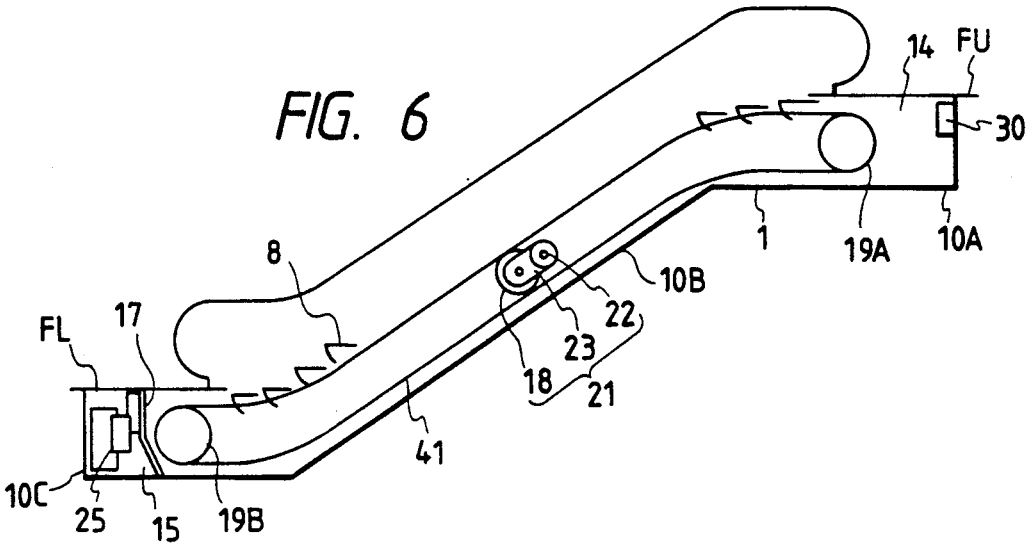
FIG. 6 schematically shows the construction of another type of an escalator, to which the present invention can be applied.

In the foregoing, the present invention is applied to an escalator. It is of course that the present invention can be applied to a so called moving sidewalk, in which treadboards linked in the endless form moves on the same level. Further, in the above embodiment, the driving device 21, including the motor 22, the reduction gear 23 and so on, has been arranged in one end of the frame, i.e., the upper machine room 14. However, the present invention is also applied to an escalator or a moving sidewalk, in which a driving device is provided in the middle portion of a frame, as shown in FIG. 6.

As shown in the figure, endless step chain 41 provided between two driven sprockets 19A and 19B is driven by the driving sprocket 18 arranged in the middle portion of the frame 1. The driving sprocket 18 is driven by the driving device 21 comprising the motor 22 and the reduction gear 23, which is also provided in the middle portion of the frame 1. Other main component devices, such as the power converting unit 25 and the operation controller 30, can be arranged in the lower machine room 15 and the upper machine room 14, similarly to the previous embodiment.

We claim:

1. A people mover apparatus, comprising:

a plurality of treadboards, coupled to each other in an endless form for conveying people from one area to another;

driving means for driving said treadboards, said driving means having a driving mechanism including an electric motor for transmitting a driving force from said electric motor to said treadboards, wherein a power converting unit is included for supplying electric power to said electric motor, said apparatus characterized in that:

component devices included in said driving means are categorized into at least two groups from the point of view of predetermined factors influencing environment of said apparatus, wherein at least said driving mechanism and said power converting unit belong to different groups, and wherein said component devices which belong to different groups are arranged in different parts of said apparatus within said apparatus, said different parts are located remotely far from each other in the direction of the length of said apparatus.

2. A people mover apparatus as set forth in claim 1, wherein said apparatus includes a frame which is provided to link different places and movably supports said treadboards, said component devices of a certain group are arranged in a part of the frame and the remaining component devices are arranged in another part which is remote from the part in the direction of the length of the frame.

3. A people mover apparatus as set forth in claim 2, wherein said component devices included in said driving means are categorized on the basis of heat generated by respective devices.

4. A people mover apparatus as set forth in claim 2, wherein said component devices included in said driving means are categorized on the basis of noise generated by respective devices.

5. A people mover apparatus as set forth in claim 2, wherein said component devices included in said driving means are categorized on the basis of mechanical vibrations created by respective devices.

6. A people mover apparatus as set forth in claim 2, wherein the driving mechanism is arranged in one end of the frame and the power converting unit in the other end of the frame.

7. A people mover apparatus as set forth in claim 6, wherein the motor in the driving mechanism and the power converting unit are connected by a shield power line.

8. A people mover apparatus as set forth in claim 7, wherein the shield power line is provided along the frame.

9. A people mover apparatus as set forth in claim 2, wherein the frame is divided into three sections composed of both end sections and a middle section therebetween, in which the driving mechanism and the power converting unit are arranged in different sections, respectively.

10. A people mover apparatus as set forth in claim 9, wherein the frame is provided with machine rooms in both of the end sections thereof, wherein the driving mechanism is installed in one of the machine rooms and the power converting unit is installed in the other machine room.

11. A people mover apparatus as set forth in claim 10, wherein at least one of the machine rooms is provided with a partition which divides one machine room of said machine rooms into a part open to the middle section of the frame and a closed part partially separated from the open part, wherein said component devices to be installed in the machine rooms are arranged in the closed part of the respective machine rooms.

12. A people mover apparatus as set forth in claim 2, wherein said apparatus is provided with a balustrade, said balustrade having a handrail moving synchronously with said treadboards, inner and outer panels are provided between said handrail and said frame for movably supporting the handrail, wherein said power converting unit is arranged in a space formed between said inner and outer panels.

13. A people mover apparatus as set forth in claim 10, wherein said apparatus is further provided with an operation control device for controlling at least a moving speed of said treadboards, wherein said operation control device is accommodated in a machine room which accommodates said component devices which generate a small amount of heat so that the temperature of the machine room is kept under an allowable temperature for said operation control device.

14. A people mover apparatus as set forth in claim 10, wherein said apparatus is further provided with an operation control device for controlling at least the moving speed of said treadboards, wherein the driving mechanism and said operation control device are installed in one of the machine rooms and the power converting unit is installed in the other machine room.

15. A people mover apparatus as set forth in claim 14, wherein the motor and the power converting unit are connected by a shield power line provided along the frame.

16. A people mover apparatus as set forth in claim 10, wherein the driving mechanism is installed in the middle section of the frame and the power converting unit is installed in one of the end sections thereof.

* * * * *